US007205974B2

(12) United States Patent
Pasqualini et al.

(10) Patent No.: US 7,205,974 B2
(45) Date of Patent: Apr. 17, 2007

(54) WINDOW BRIGHTNESS ENHANCEMENT FOR LC DISPLAY

(75) Inventors: Giuseppe Pasqualini, Monza (IT); Carlo Casale, Busto Arsizio (IT)

(73) Assignee: Koninklijke Philips Electronics, N.V., Eindhoven (NL)

( * ) Notice: Subject to any disclaimer, the term of this patent is extended or adjusted under 35 U.S.C. 154(b) by 380 days.

(21) Appl. No.: 10/509,452

(22) PCT Filed: Mar. 11, 2003

(86) PCT No.: PCT/IB03/00933

§ 371 (c)(1),
(2), (4) Date: Sep. 28, 2004

(87) PCT Pub. No.: WO03/083817

PCT Pub. Date: Oct. 9, 2003

(65) Prior Publication Data

US 2005/0219198 A1 Oct. 6, 2005

(30) Foreign Application Priority Data

Apr. 2, 2002 (EP) ..... 02076304

(51) Int. Cl.
*G09G 3/36* (2006.01)

(52) U.S. Cl. ..... 345/102; 345/87; 345/77; 345/204; 345/690

(58) Field of Classification Search ..... 345/102, 345/87, 77, 204, 690
See application file for complete search history.

(56) References Cited

U.S. PATENT DOCUMENTS

| | | | | |
|---|---|---|---|---|
| 4,928,181 | A * | 5/1990 | Harward | 348/766 |
| 5,479,187 | A | 12/1995 | Chen | 345/102 |
| 5,592,193 | A | 1/1997 | Chen | 345/102 |
| 6,069,449 | A * | 5/2000 | Murakami | 315/158 |
| 6,078,302 | A | 6/2000 | Suzuki | |
| 6,175,353 | B1 * | 1/2001 | Hoeksma | 345/102 |
| 6,980,195 | B2 * | 12/2005 | Lonoce et al. | 345/102 |
| 2006/0038771 | A1 * | 2/2006 | Hirakata et al. | 345/102 |

FOREIGN PATENT DOCUMENTS

WO WO 0259732 A1 8/2002

* cited by examiner

*Primary Examiner*—Richard Hjerpe
*Assistant Examiner*—Leonid Shapiro

(57) ABSTRACT

In a LCD monitor, a predetermined part (PA) of the displayed information is highlighted by causing the backlighting (BLU) to produce more light. The area outside the predetermined area (PA) is kept at a substantially constant brightness by adjusting the video data driving the panel (LCD). A booster (BO) is added to control the lamp (BLL) such that the amount of light produced by the backlighting (BLU) increases in a controlled and predictable way so the user does not notice a transition in terms of brightness in the area outside the predetermined area (PA).

7 Claims, 2 Drawing Sheets

WINDOW BRIGHTNESS ENHANCEMENT FOR LC DISPLAY

FIELD OF THE INVENTION

The invention relates to a system comprising a display apparatus with a liquid crystal display for displaying a display signal and a computer for generating the display signal and an enhancement control signal for indicating a required enhancement of a predetermined area on the liquid crystal display. The invention further relates to a display suitable for use in such a system.

BACKGROUND OF THE INVENTION

From Philips computer monitors in the market the feature lightframe™ is known. This feature enables the user to select an area on the screen of a display device in which the brightness should be increased. This is especially advantageous if natural information is displayed in the area. Natural information comprises photos and films which typically have a lower resolution than synthetic information such as text. The perceptual quality of this low resolution information improves considerably by increasing the brightness, while the brightness of the high resolution synthetic information should not be increased to avoid blurring. Usually, the area is a window or a part of a window created by the operating system and/or by an application running on an operating system.

In cathode ray tubes, the increased brightness is created by increasing the beam current in the cathode ray tube locally in the high brightness area.

In liquid crystal displays, the maximum brightness is determined by the light output of the backlight. If the light output of a predetermined area has to be increased, the light output of the backlight has to be increased and the data outside the predetermined area has to be adapted to keep the brightness substantially constant outside the predetermined area.

A typical backlight lamp driver architecture is disclosed in U.S. Pat. No. 6,078,302. A lamp unit is intermittently driven by a lamp driver circuit which is a current source which supplies the optimal drive current to the backlighting unit. The lamp driver circuit supplies the current to the lamp unit via a controlled switch. A drive current adjuster controls the switch to perform a pulse width control of the drive current. The drive current adjuster can be manually adjusted by a user via a brightness control input.

Due to the current control architecture and the lamp intrinsic behaviour it is difficult to achieve a fast response time of the lamp when a change in the amount of light produced is required.

SUMMARY OF THE INVENTION

It is an object of the invention to provide a backlighting unit which is able to change a property of the light it produces in a controlled way.

A first aspect of the invention provides a system as claimed in claim 1. A second aspect of the invention provides a display apparatus as claimed in claim 7. Advantageous embodiments are defined in the dependent claims.

In the Light Frame implementation in LCD monitors, only part of the picture on the screen has to be highlighted while the remaining part of the screen has to be dimmed by adjusting the data driving the panel. The invention is based on the recognition that in order to reduce the switching effect perceived by the user, the amount of light produced by the back lighting has to be increased in a period of time roughly equal to the time required by the dimming procedure. More general, the shape of light variation of the lamp should match the change of the transmission variation of the LCD versus time. It is a drawback that the dimming procedure is faster (or slower) than the response of the currently available backlight driving circuits. Therefore, the invention describes a way for obtaining a transition time and transition shape of the light produced by the lamp of the backlight unit which is matched to the transition time and shape of the dimming procedure of the data in order to minimize the switching effect perceived by the user of the not highlighted area. Thus, the control of the lamp current can be additive or subtractive depending on the behavior of the lamp and the LCD. So, if the lamp behavior is too slow with respect to the LCD cell the current has to be boosted and vice-versa.

The system comprises a display apparatus with a liquid crystal display, and a computer which generates a display signal to be displayed on the liquid crystal display. The computer further generates an enhancement control signal for indicating a required enhancement of a predetermined area on the liquid crystal display. The predetermined area corresponds to a portion of the display signal. The predetermined area may be one or more windows which may even overlap and which may be generated by the operating system or an application. The enhancement may be an increased brightness or an adapted white color or other features.

The display apparatus further comprises a backlighting system with a backlighting lamp to illuminate the liquid crystal display. A lamp driver circuit drives the backlighting lamp to change a property of the light generated when the enhancement control signal indicates that the enhancement is required. For example, the property of the lamp light may be the brightness or the color temperature.

A signal controller receives the display signal and the enhancement control signal to adapt the display signal such that a substantially unchanged display of the display signal outside the predetermined area is obtained when the enhancement control signal indicates that the enhancement is required. In this way, outside the predetermined area, the change of the property of the light is compensated for by adapting the display signal. Consequently, the (perceived) display of the information outside the predetermined area is substantially independent of the status of the enhancement control signal.

The lamp driver comprises a booster coupled to the lamp driver circuit for controlling the change of the property of the light. Thus, the booster controls the lamp driver to change the property of the light in a way to match the changing of the not highlighted display area.

For example in systems where the lamp is slower than the LCD cell, without the booster, the produced lamp brightness may take several seconds to reach its final steady state level. This causes several problems.

First, outside the area in which the higher brightness is required, it is difficult to compensate the slow increase of the light output of the lamp by slowly adapting the display signal. The response of the lamp depends on the characteristics of the lamp used, and on the actual status of the lamp (for example its temperature). Further, the compensation is difficult because of the non-linear behavior of the cells of the liquid crystal display.

Secondly, the user will become confused when it takes several seconds for a selected portion of the displayed information to become enhanced. Usually, the user will move a mouse pointer over the selected portion, activate the mouse button, and expect an immediate response. If the response time is slow and it needs several seconds for a reaction occurs, the user may conclude that he did something wrong, or that the lightframe feature is not working properly. With the boosting, it takes a few milliseconds only to change the brightness. Consequently, by the lamp control in accordance with the invention, the Lightframe feature can be more impressive to the final user because of the light variation, in the highlighted area, can be reached in a very short time. Preferably, the booster causes an additional current through the lamp when an increase of the light output is required, or the booster causes a subtractive current through the lamp when a decrease of the light output is required. This additional or subtractive current amount causes the lamp to reach the steady state brightness value much faster or slower. In this way, the lamp is controlled such that the amount of light produced by the backlighting increases in a controlled way, and consequently, the user does not notice a transition in the area outside the predetermined area due to the compensation of the changed light output of the backlighting by the adaptation of the data.

The amount and the shape of this additive/subtractive current may be a function of several parameters like temperature, initial and final desired brightness level etc..

These and other aspects of the invention are apparent from and will be elucidated with reference to the embodiments described hereinafter.

DETAILED DESCRIPTION OF THE PREFERRED EMBODIMENT

Figure 1:
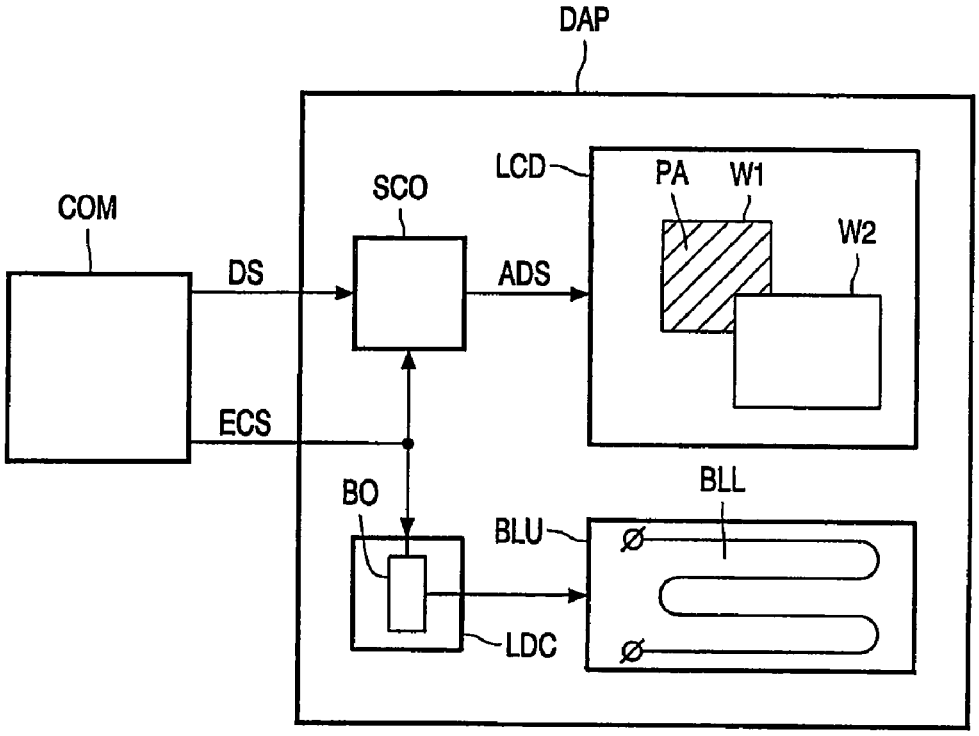
FIG. 1 shows a system of a computer and a display apparatus in accordance with the invention.

FIG. 1 shows a system of a computer and a display apparatus in accordance with the invention. This embodiment is directed to situations wherein the lamp has to be boosted because its behavior is slower than the LCD cell. The computer COM supplies a display signal DS to be displayed on a display apparatus DAP with a liquid crystal display LCD. The computer COM further generates an enhancement control signal ECS which indicates a required increased brightness of a predetermined area PA on the liquid crystal display LCD. The enhancement control signal may be embedded in the display signal DS and decoded by the signal controller SCO. The predetermined area PA is, for example, shown as a window W1 generated by the operating system or an application. The window is partly covered by the window W2.

The display apparatus DAP further comprises a backlighting unit BLU with a backlighting lamp BLL which illuminates the liquid crystal display LCD. A lamp driver circuit LDC drives the backlighting lamp BLL to change a property of the light generated when the enhancement control signal ECS indicates that the increased brightness is required.

A signal controller SCO receives the display signal DS and the enhancement control signal ECS to generate an adapted display signal ADS such that a substantially unchanged display outside the predetermined area PA is obtained when the enhancement control signal ECS indicates that the enhancement is required. The adapted display signal ADS is supplied to the liquid crystal display LCD. In this way, outside the predetermined area PA, the brightness change is compensated by adapting the display signal DS.

The lamp driver circuit LDC comprises a booster BO which adapts the drive of the backlighting lamp BLL to control the change of the brightness.

Figure 2:
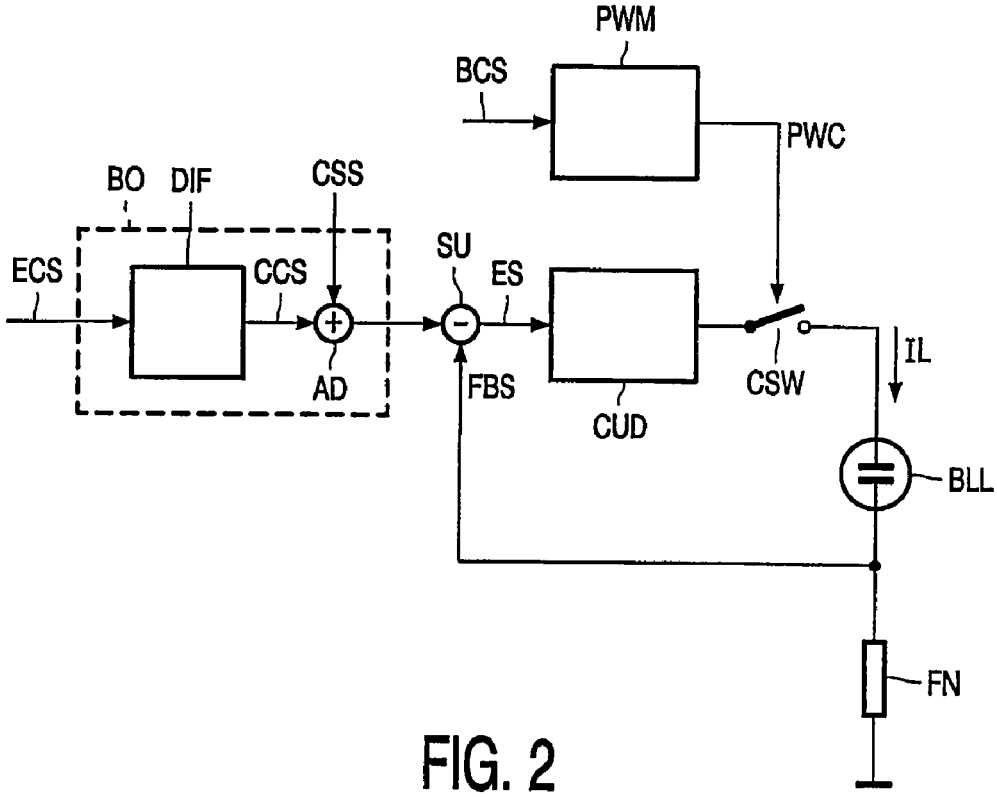
FIG. 2 shows an embodiment of the backlighting unit in accordance with the invention.

FIG. 2 shows an embodiment of the backlighting unit in accordance with the invention.

The booster BO comprises a differentiator DIF which receives the enhancement control signal ECS to supply the differentiated control signal CCS. In a preferred embodiment, the enhancement control signal ECS may be replaced by the user adjustable brightness control signal BCS to which the enhancement control signal ECS is added.

An adder AD adds the differentiated control signal CCS to the current control signal CSS. The current control signal CSS determines the steady state current IL supplied to the lamp BLL.

A feedback element FN is arranged in series with the lamp BLL to supply a feedback signal FBS which represents the lamp current IL. A subtractor SU subtracts the feedback signal FBS from the output signal of the adder AD to supply an error signal ES to the current controller CUD.

The current controller CUD supplies the lamp current IL via the controllable switch CSW to the lamp BLL. The on/off switching of the controllable switch CSW is controlled by the pulse width modulator PWM. The pulse width modulator PWM generates a pulse width control signal PWC which has a duty cycle dependent on the user controllable brightness control signal BCS.

In the steady state, the current IL through the lamp BLL is determined by the current control signal CSS. The current IL determines the brightness of the light emitted by the lamp BLL. It is therefore important that the current IL is kept accurately at the desired value, when the controllable switch CSW is closed. The current is kept at the desired value indicated by the current control signal CSS by the current feedback loop which comprises the subtractor SU, the current controller CUD, and the feedback element FN. Usually, the feedback element FN is a resistor through which the current IL generates a feedback voltage as the feedback signal FBS. The subtractor SU compares the actual measured current IL through the lamp BLL with the desired current as indicated by the current control signal CSS to control the current controller CUD in a known manner to keep the current IL accurately at the desired value.

The brightness of the lamp BLL is controlled by the duty cycle of the controllable switch CSW. The current IL flows through the lamp BLL only during the time that the switch CSW is closed. If this time is short (the duty cycle is small) with respect to the time that the switch CSW is open, the brightness is low. Usually, the user controllable brightness input which generates the user controllable brightness control signal BCS controls the duty cycle via the pulse width modulator PWM.

To conclude, the actual lamp brightness value is obtained by controlling the duty cycle. During the on state of the lamp BLL, the current IL is regulated by the closed control loop at a desired nominal value which may be different for different lamp types.

In the lightframe application the back light lamp brightness has to be switched from one value to another. As elucidated before, a fast and controlled response time of the resulting brightness is required. The differentiator DIF differentiates the enhancement control signal ECS to obtain the differentiated control signal CCS which is proportional to the step applied to the enhancement control signal ECS. The enhancement control signal ECS is functionally related to the brightness control signal BCS. The current IL through the lamp BLL will be boosted for a short period in time, and consequently, the new brightness level set by brightness control signal BCS will be reached much earlier.

Figure 3:
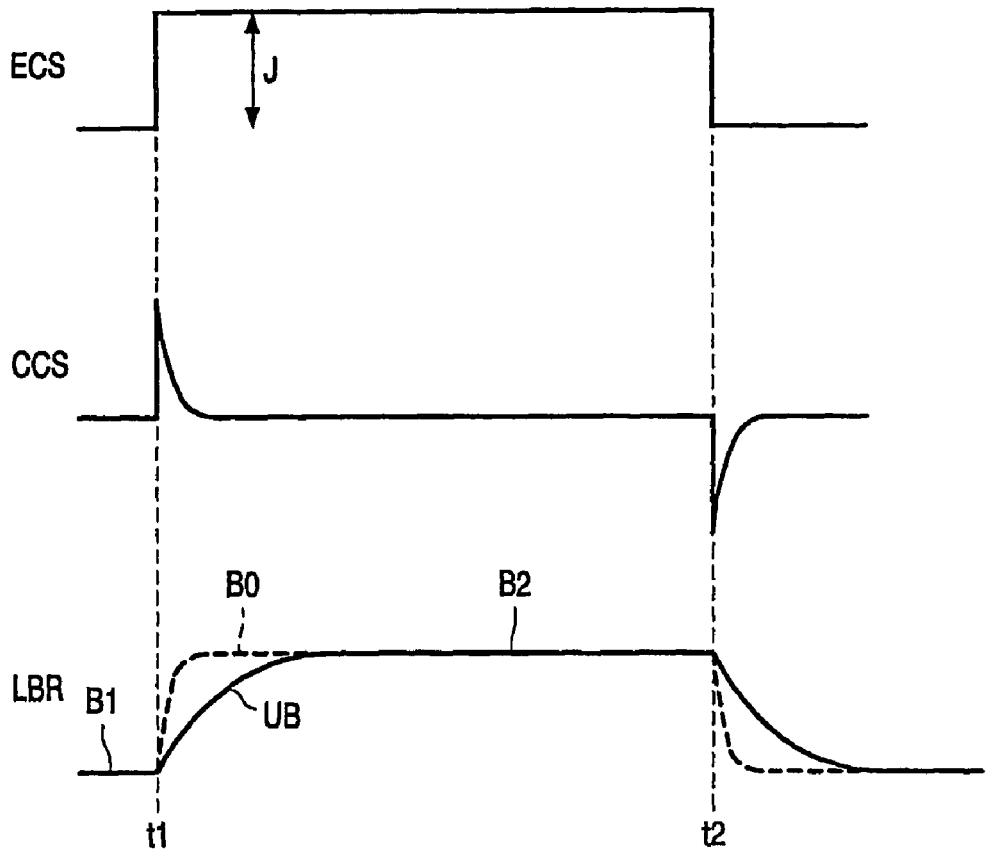
FIG. 3 shows waveforms elucidating the operation of the embodiment of the backlighting unit in accordance with the invention.

FIG. 3 shows waveforms elucidating the operation of the embodiment of the backlighting unit in accordance with the invention. FIG. 3 shows the enhancement control signal ECS, the differentiated control signal CCS, and the brightness LBR of the lamp BLL.

Before the instant t1, the enhancement control signal ECS, which in this situation is the brightness control signal BCS has a value indicating a first brightness level (no enhancement is required). The enhancement control signal ECS is zero and the brightness LBR has a level B1.

At the instant t1, the enhancement control signal ECS makes a jump J to a value indicating a second brightness level (the enhancement, which is in this example a higher brightness). Without boosting, the differentiated control signal CCS stays zero, it takes a considerable amount of time before the brightness LBR reaches the second level B2, as is shown by the waveform UB. The differentiated control signal CCS shows a differentiated enhancement control signal ECS. With boosting, the differentiated control signal CCS which is the differentiated enhancement control signal ECS shows a spike. The spike causes a corresponding spike in the current IL through the lamp BLL and the second brightness level will be reached much faster as is shown by the partly dashed waveform BO.

At the instant t2, in a same way, the brightness LBR of the lamp BLL is decreased within a short time.

To conclude, usually, if the enhancement control signal ECS is the brightness control signal BCS, and in a predetermined area PA a higher brightness is required, the steady state brightness of the lamp BLL is increased by increasing the duty cycle. The fast transition in the light output is obtained by temporary boosting the current IL through the lamp BLL.

Figure 4:
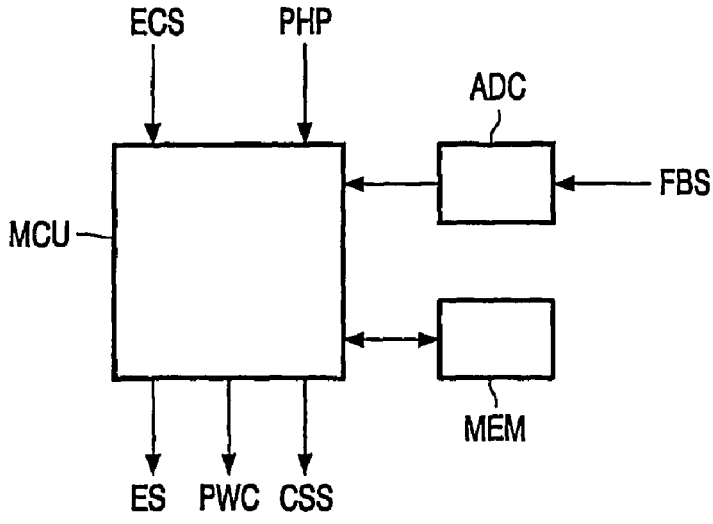
FIG. 4 shows another embodiment of the backlighting unit in accordance with the invention.

FIG. 4 shows another embodiment of the backlighting unit in accordance with the invention.

In this embodiment a microcontroller MCU, receives the enhancement control signal ECS separately or retrieves it from the display signal DS. The microcontroller MCU generates the brightness control signal BCS, or, as shown, directly the pulse width control signal PWC and the current control signal CSS. The current control signal usually is an analog signal and can be easily be obtained by filtering a high frequency pulse width modulated signal generated by the microcontroller MCU. Further, the microcontroller MCU has an input to receive physical parameters PHP like the panel or/and the lamp temperature, and/or the behavior of the LCD cells.

Optionally, the microcontroller MCU may receive the feedback signal FBS and supply the error signal ES. In this way a totally digital control loop can be achieved but this requires an analog to digital converter ADC that may be external or embedded in the microcontroller MCU.

The microcontroller MCU knows the physical parameters PHP of the whole system. These parameters PHP can differ among different manufactured monitors even if assembled with same components due to the spreading of the nominal values. Preferably, the parameters PHP are measured at the final stage of the manufacturing process and stored in a memory storage device MEM which may be embedded in the microcontroller MCU. When the MCU recognizes that the brightness has to be changed from one value to another it generates the proper pulse width control signal PWC and the current control signal CSS in order to meet the transmission variation of the LCD cells. These signals generated by the microcontroller MCU will depend on the desired brightness jump, and may be related to the parameters PHP received by the MCU.

It should be noted that the above-mentioned embodiments illustrate rather than limit the invention, and that those skilled in the art will be able to design many alternative embodiments without departing from the scope of the appended claims. For example, the lamp BLL may be a single lamp, or a may comprise multiple lamps. The feedback element FN may be a current transformer. It is possible to highlight several areas. The areas may have a non rectangular shape.

In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. In a system comprising a display apparatus (DAP), and a computer (COM) for generating a display signal (DS) and an enhancement control signal (ECS) indicating a required enhancement of the display signal (DS) within a predetermined area (PA) on a display screen of the display apparatus (DAP), the display apparatus (DAP) comprises:

a liquid crystal display (LCD), a backlighting unit (BLU) with a backlighting lamp (BLL) for generating light to illuminate the liquid crystal display (LCD), a lamp driver circuit (LDC) for driving the backlighting lamp (BLL) to change a property of the light emitted when the enhancement control signal (ECS) indicates that the enhancement is required, and a signal controller (SCO) for receiving the display signal (DS) and the enhancement control signal (ECS) to supply an adapted display signal (ADS) to the liquid crystal display (LCD) to obtain an adapted transmission of the liquid crystal display (LCD), wherein the lamp driver circuit (LDC) comprises a booster (BO) for receiving the enhancement control signal (ECS) to match the change of the property of the light with the adapted transmission of the liquid crystal display (LCD), to obtain a substantially unchanged display of the display signal (DS) outside the predetermined area (PA) when the enhancement control signal (ECS) indicates that the enhancement is required.

2. The system as claimed in claim 1, characterized in that the property of the light is its brightness.

3. The system as claimed in claim 2, characterized in that the lamp driver circuit (LDC) comprises a current generator (CUD) for generating a current (IL) through the backlighting lamp (BLL), and that the booster (BO) comprises a means (DIF) for supplying a current control signal (CCS) to the current generator (CUD) to adapt the current (IL) through the backlighting lamp (BLL) when the enhancement control signal (ECS) indicates a required enhancement of the brightness of the predetermined area (PA).

4. The system as claimed in claim 2, characterized in that the lamp driver circuit (LDC) comprises:

a pulse width modulator (PWM for generating a pulse width control signal (PWC) having a duty cycle dependent on a user controllable brightness control signal (BCS), a series arrangement of a current driver (CUD), a switching device (CSW), and the backlighting lamp (BLL), the current driver (CUD) has an input for receiving an input signal (ES) and an output for supplying a predetermined current (IL) to the backlighting lamp (BLL) when the switching device (CSW) is closed, the switching device (CSW) has a control input for receiving the pulse width control signal (PWC) to determine on and off times of the switching device (CSW), and the booster (BO) further comprises a differentiator (DIF) for differentiating the enhancement control signal (ECS) to obtain a differentiated control signal (CCS), and an adder (AD) for adding the differentiated control signal (CCS) to a current control signal (CSS) to supply the input signal (ES).

5. The system as claimed in claim 2, characterized in that the lamp driver circuit (LDC) comprises a microcontroller (MCU) for receiving a physical parameter (PHP) representative for the transmission behavior of the liquid crystal display (LCD) and/or the light emission of the lamp (BLL) to determine the current control signal (CCS) and/or the pulse width control signal (PWC).

6. The system as claimed in claim 2, characterized in that the lamp driver circuit (LDC) comprises a microcontroller (MCU) and a memory (MEM) comprising stored data of a physical parameter (PHP) representative for the transmission behavior of the liquid crystal display (LCD) and/or the light emission of the lamp (BLL).

7. A display apparatus comprising a liquid crystal display (LCD), a backlighting unit BLU) with a backlighting lamp (BLL) for generating light to illuminate the liquid crystal display (LCD), a lamp driver circuit (LDC) for driving the backlighting lamp (BLL) to change a property of the light emitted when an enhancement control signal (ECS) indicates that the enhancement is required, and a signal controller (SCO) for receiving a display signal (DS) and the enhancement control signal (ECS) to supply an adapted display signal (ADS) to the liquid crystal display (LCD) to obtain an adapted transmission of the liquid crystal display (LCD), wherein the lamp driver circuit (LDC) comprises a booster (BO) for receiving the enhancement control signal (ECS) to match the change of the property of the light with the adapted transmission of the liquid crystal display (LCD), to obtain a substantially unchanged display of the display signal (DS) outside the predetermined area (PA) when the enhancement control signal (ECS) indicates that the enhancement is required.

* * * * *